United States Patent [19]

Fast

[11] Patent Number: 4,537,821

[45] Date of Patent: Aug. 27, 1985

[54] MERCHANDISE INFORMATION DISPLAY TAG WITH GUIDE MEANS

[76] Inventor: Jacob Fast, 6850 NW. 12th Ave., Ft. Lauderdale, Fla. 33309

[21] Appl. No.: 574,617

[22] Filed: Jan. 27, 1984

[51] Int. Cl.[3] ..... G09F 3/02

[52] U.S. Cl. ..... 428/121; 40/16.4; 40/489; 40/622; 248/220.4; 248/221.4; 428/133; 428/187

[58] Field of Search ..... 248/73, 220.4, 221.3, 248/221.4; 40/16.4, 2 R, 19.5, 20 R, 622, 624, 489; 428/121, 133, 187

[56] References Cited

U.S. PATENT DOCUMENTS

| | | | |
|---|---|---|---|
| 1,132,337 | 3/1915 | Green | 40/489 X |
| 1,590,722 | 6/1926 | Brakmeier | 40/16.4 X |
| 2,369,380 | 2/1945 | Tinnerman | 428/31 X |
| 2,423,818 | 7/1947 | Schmutzler | 40/2 R |
| 2,461,054 | 2/1949 | Green | 40/2 R X |
| 2,587,912 | 3/1952 | Simpson | 248/221.3 |
| 2,814,894 | 12/1957 | Horton | 40/489 |
| 3,074,133 | 1/1963 | Jones | 40/2 X |
| 3,989,210 | 11/1976 | Berkman et al. | 248/73 |
| 4,215,518 | 8/1980 | Blair | 428/542.2 X |
| 4,319,417 | 3/1982 | Schimmel | 40/160 X |
| 4,329,191 | 5/1982 | Barber | 428/187 X |
| 4,413,027 | 11/1983 | Bildl | 428/67 X |
| 4,463,510 | 8/1984 | Windish | 40/2 R X |
| 4,476,983 | 10/1984 | Fast | 248/220.4 X |

FOREIGN PATENT DOCUMENTS

| | | | |
|---|---|---|---|
| 323145 | 12/1929 | United Kingdom | 40/622 |

*Primary Examiner*—Henry F. Epstein
*Attorney, Agent, or Firm*—Holman & Stern

[57] ABSTRACT

Accurate positioning of a portable coded data reader, such as is used for reading merchandise bar codes, is achieved by a plastic display tag having a guide ledge formed integrally with a display section in which the coded indicia are displayed. When the reader is slid along the ledge it is automatically positioned properly to read the coded indicia. The guide ledge is separated from the display section by a fold line which permits the ledge to be folded substantially perpendicular to the display section. A second guide ledge may also be provided to define a guide channel between the two ledges. Mounting projections are formed integrally with the tag and project from opposite sides of the display section to engage respective apertures in an apertured support structure.

12 Claims, 6 Drawing Figures

MERCHANDISE INFORMATION DISPLAY TAG WITH GUIDE MEANS

BACKGROUND OF THE INVENTION

1. Technical Field

The present invention relates to merchandise information display tags and, more particularly, to such tags which are configured to properly position and guide a portable automatic reader of coded indicia, such as bar codes. In addition, the invention relates to a novel method of guiding a portable bar code reader, or the like, during a reading procedure.

2. Discussion of the Prior Art

During inventory procedures in many retail establishments, bar code, or other coded indicia which are displayed near the identified merchandise, are read by a portable code reader. If the reader is not properly oriented relative to the displayed coded indicia, the reader may register the wrong information, or the reading procedure may be rejected by the apparatus, thereby, necessitating repeated readings until the data is acceptable.

OBJECT AND SUMMARY OF THE INVENTION

It is therefore an object of the present invention to provide a method and apparatus for reliably positioning a portable coded indicia reader, particularly a bar code reader, during a code reading procedure.

It is another object of the present invention to provide an improved merchandise information display tag which is suitable for receiving coded indicia, such as a bar code, and which permits a code reader to be accurately positioned and guided to reliably read the displayed code.

In accordance with the present invention, a plastic tag includes a display surface on which coded indicia are presented for display. A guide ledge is formed integrally with the tag and separated from the display portion by means of a fold line which permits the ledge to be folded subtantially perpendicular to the display portion. The ledge serves as a guide along which a card reader may be translated so as to be properly oriented relative to a sequence of the coded indicia on the display portion. Also formed integrally with the tag are a pair of mounting projections extending from opposite ends of the display portion so as to be suitable for engagement in apertures in an apertured support structure.

BRIEF DESCRIPTION OF THE DRAWINGS

These and other objects, features and many of the attendant advantages of the present invention will be better understood upon a reading of the following detailed description when considered in connection with the accompanying drawings wherein like parts in each of the several figures are identified by the same reference numerals, and wherein.

DESCRIPTION OF THE PREFERRED EMBODIMENTS

Figure 1:
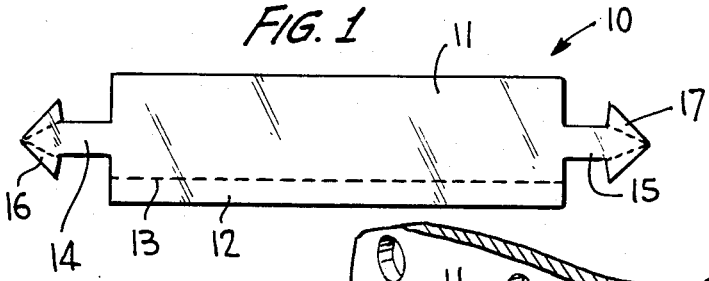
FIG. 1 is a front view in elevation of a merchandise information display tag, prior to deployment, in accordance with one embodiment of the present invention.
Figure 2:
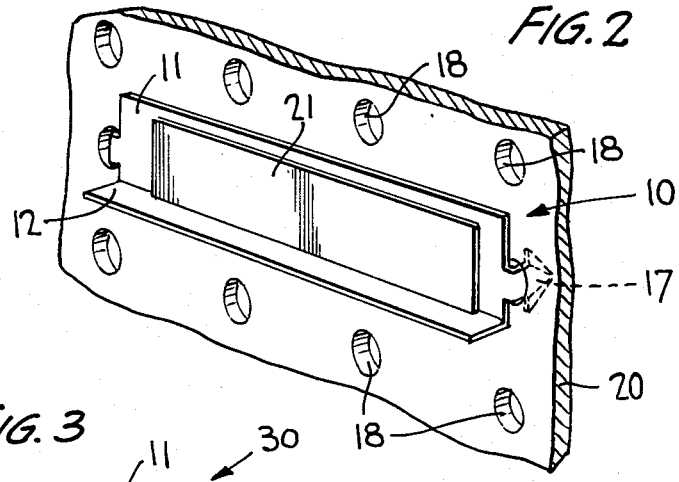
FIG. 2 is a view of the merchandise information display tag of FIG. 1 deployed for use in conjunction with an apertured board support structure.

Referring specifically to FIGS. 1 and 2 of the accompanying drawings, a merchandise information display tag 10 is made from an integral sheet of plastic material and includes an information display section 11 of generally rectangular configuration. A guide ledge section 12 is formed integrally with the display section 11 and separated therefrom by a perforated fold line 13 extending along one of the longer edges of the rectangular display section 11. The fold line 13 permits guide ledge 12 to be folded and retained in a position substantially perpendicular to the display section 11, in which position the guide ledge 12 projects forwardly of the display section. A pair of mounting projections 14 and 15 extend from opposite edges of the display portion 11 in a direction which is generally parallel to the fold line 13. The distal ends of each of mounting portions 14 and 15 are widened to form respective anchor sections 16 and 17. The anchor sections 16 and 17 are provided with fold lines which permit the anchor sections to be radially compressed and inserted through suitable respective apertures 18 in an apertured support structure 20. In order to so insert the anchor sections 16 and 17 through apertures 18, the projections 14 and 15 must be bent rearwardly, as best illustrated in FIG. 2. When the anchor sections 16 and 17 are positioned behind the apertured board 20, the anchors are unfolded so as to prevent inadvertent withdrawal of the anchors and removal of the tag 10 from the support structure 20.

The forward facing surface of display portion 11 is adapted to receive an adhesive-backed strip 21 on which coded indicia, such as a merchandise bar code, are imprinted in a sequence extending from left to right as viewed in FIG. 2. Guide ledge 12, when deployed in its folded position as illustrated in FIG. 2, assures that the code reader is properly positioned relative to the imprinted coded indicia. Specifically, the code reader is rested against ledge 12 and moved along the ledge during a reading procedure. The ledge assures that the reader is properly oriented with respect to strip 21 so that the indicia printed on the strip properly register with the reader.

Figure 3:
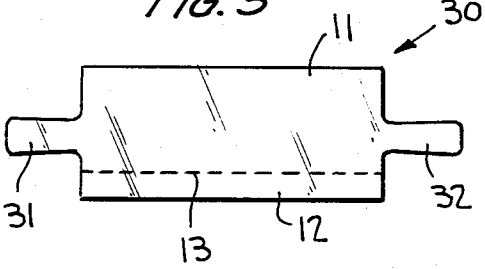
FIG. 3 is a view in plan of a second embodiment of the merchandise information display tag of the present invention, showing the tag prior to deployment.
Figure 4:
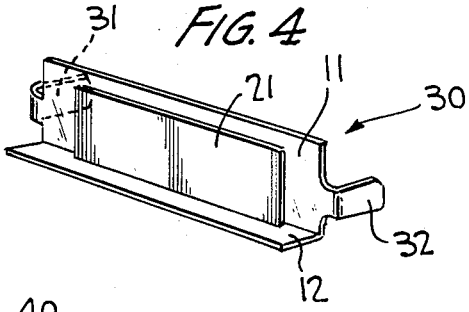
FIG. 4 is a view in perspective showing the merchandise information display tag of FIG. 3 in deployed condition.

Referring specifically to FIGS. 3 and 4, a second merchandise display tag embodiment 30 of the present invention has a display portion 11 and guide ledge 12 similar to the corresponding elements in the embodiments of FIG. 1. The tag 30 differs from tag 10 of FIG. 1 in the configuration of the mounting projections 31 and 32 which do not have foldable anchors at their distal ends. Instead, the mounting projections 31 and 32 are merely bent rearwardly and their rounded edges are inserted into suitable apertures in an apertured support structure without anchors to lock the tag onto the support structure. In most cases the resilience of the mounting projections 31 and 32 serves to maintain the tag 30 properly mounted on the support structure.

Figure 5:
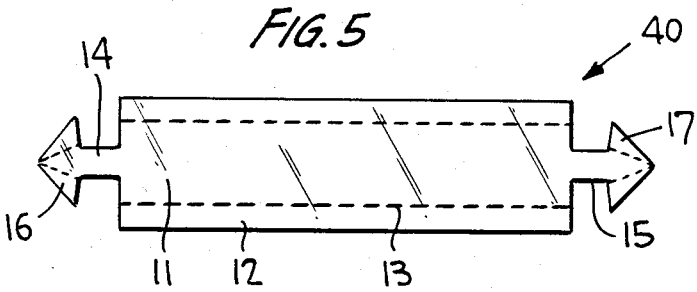
FIG. 5 is a view in plan of still another merchandise information display tag of the present invention shown in a non-deployed condition.
Figure 6:
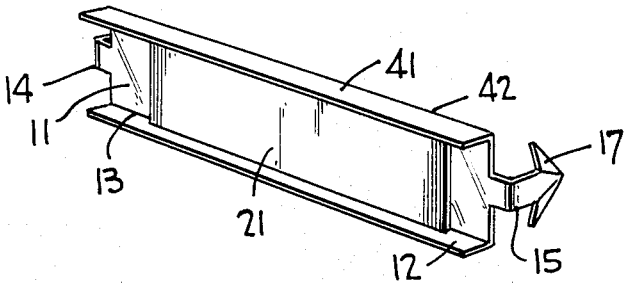
FIG. 6 is a view in perspective of the merchandise information display tag of FIG. 5, showing the tag in deployed condition.

Still another embodiment of the invention is illustrated in FIGS. 5 and 6 to which specific reference is now made. Information display tag 40 is similar to tag 10 but includes an additional ledge 41 separated from display portion 11 by means of a perforated fold line 42. Ledge 41 is disposed on the opposite edge of display portion 11 from ledge 12, and fold line 42 is disposed parallel to fold line 13. When the two ledges 12 and 41 are folded perpendicular to display portion 11, the ledges form a channel therebetween in which the portable code reader may be guided along strip 21. In other words, the merchandise display tag 40 provides a two-sided guide ledge arrangement for properly positioning the code reader in reading the bar code.

From the foregoing description it will be appreciated that the invention resides in providing a guide ledge for permitting reliable reading of a bar code or similar coded indicia from a merchandise information display tag. A single pass of the code reader is all that is necessary to reliably register the coded data.

Having described several embodiments of a new and improved method and apparatus for guiding an automatic code reader during a reading procedure from a merchandise information display tag, it is believed that other modifications, variations and changes will be suggested to those skilled in the art in view of the description set forth above. It is therefore to be understood that all such variations, modifications and changes are believed to fall within the scope of the invention as defined in the appended claims.

What is claimed is:

1. An article of manufacture for displaying coded indicia in a manner which permits the indicia to be read by a portable automatic code reading apparatus which is translated along said coded indicia, said article comprising: a plastic sheet having a first section with a display surface on which said coded indicia are to be placed for display, means for guiding and properly positioning said code reading apparatus relative to said coded indicia on said first section when said code reading apparatus is translated along said coded indicia, said means comprising a second section formed integrally with said first section and joined to said first section by a first fold line along which the sheet may be folded to project said second section out of plane with respect to said first section to define a positional guide surface along said second section for said portable code reading apparatus when said code reading apparatus is moved along said display surface to read said coded indicia, and projectional support means formed integrally with said sheet for securing said sheet to a support structure.

2. The article of manufacture according to claim 1 wherein said second section has a generally rectangular configuration and is adapted to be disposed substantially perpendicular to said first section when said sheet is folded along said fold line.

3. The article of manufacture according to claim 2 wherein said first section is substantially rectangular and has the same width dimension as said second section, said width dimension extending along the direction of movement of said card reading apparatus during reading of said coded indicia.

4. The article of manufacture according to claim 3 wherein said means for guiding further includes a third section formed integrally with said first section and joined to said first section by a second fold line disposed parallel to said first fold line and along which said sheet may be folded to project said third section generally perpendicular to said first section to define a guide channel for said code reading apparatus between said second and third folded sections.

5. The article of manufacture according to claim 3 wherein said support means comprises first and second support projections formed integrally with said first section and extending from opposite ends, respectively of said first section in generally parallel relation to said first fold line.

6. The article of manufacture according to claim 5 wherein each support projection has a distal end which widens to form an anchor that can be folded for insertion into respective apertures of an apertured support panel and unfolded behind the apertured panel to prevent withdrawal of the anchors from the aperture.

7. The article of manufacture according to claim 1 wherein said means for guiding further includes a third section formed integrally with said first section and joined to said first section by a second fold line which is disposed parallel to said first fold line and along which said sheet may be folded to project the third section out of plane with respect to said first section to define a guide channel for said code reading apparatus between said second and third folded sections.

8. The article of manufacture according to claim 1 wherein said support means comprises first and second support projections formed integrally with said first section and extending from opposite ends, respectively, of said first section in generally parallelled relation to said first fold line.

9. The article of manufacture according to claim 8 wherein each support projection has a distal end which widens to form an anchor that can be folded for insertion into respective apertures of an apertured support panel and unfolded behind the apertured panel to prevent withdrawal of the anchor from the aperture.

10. An article of manufacture comprising a plastic sheet having as integrally formed portions thereof:

a display surface for receiving coded indicia;

guide means for positionally guiding a reading apparatus employed to automatically read said coded indicia, said guide means being a ledge section of said plastic sheet folded substantially perpendicular to said display surface; and mounting means for securing said plastic sheet to a support structure.

11. The article of manufacture according to claim 10 wherein said mounting means comprises first and second projections extending from respective opposite ends of said display surface.

12. The article of manufacture according to claim 10 wherein said guide means comprises first and second spaced ledge sections of said plastic sheet folded along opposite edges of said display surface to define a guide channel having said display surface as the channel bottom and having the first and second ledges as the channel sides.

* * * * *